US007463226B2

(12) United States Patent
Wakita

(10) Patent No.: US 7,463,226 B2
(45) Date of Patent: Dec. 9, 2008

(54) DRIVER CIRCUIT AND DISPLAY DEVICE

(75) Inventor: Naohide Wakita, Osaka (JP)

(73) Assignee: Panasonic Corporation, Osaka (JP)

( * ) Notice: Subject to any disclaimer, the term of this patent is extended or adjusted under 35 U.S.C. 154(b) by 530 days.

(21) Appl. No.: 10/553,228

(22) PCT Filed: Apr. 20, 2004

(86) PCT No.: PCT/JP2004/005599

§ 371 (c)(1),
(2), (4) Date: Oct. 14, 2005

(87) PCT Pub. No.: WO2004/095406

PCT Pub. Date: Nov. 4, 2004

(65) Prior Publication Data

US 2006/0209055 A1 Sep. 21, 2006

(30) Foreign Application Priority Data

Apr. 23, 2003 (JP) ..... 2003-118239

(51) Int. Cl.
*G09G 3/34* (2006.01)
*G09G 3/20* (2006.01)

(52) U.S. Cl. ..... 345/84; 345/85; 345/86; 345/87; 345/105; 345/106; 345/107

(58) Field of Classification Search ..... 345/84, 345/85, 86, 87, 105, 106, 107, 901; 902/25, 902/26

See application file for complete search history.

(56) References Cited

U.S. PATENT DOCUMENTS

| | | | | |
|---|---|---|---|---|
| 6,650,305 | B1 * | 11/2003 | Havey et al. | 345/8 |
| 6,703,926 | B2 * | 3/2004 | Paulo | 340/425.5 |
| 7,161,590 | B2 * | 1/2007 | Daniels | 345/204 |
| 2002/0163513 | A1 | 11/2002 | Tsuji | |
| 2002/0180719 | A1 | 12/2002 | Nagai et al. | |
| 2004/0041800 | A1 * | 3/2004 | Daniels | 345/204 |

FOREIGN PATENT DOCUMENTS

| | | | |
|---|---|---|---|
| JP | 5-202358 | | 8/1993 |
| JP | 11-352919 | | 12/1999 |
| JP | 2001-344578 | A | 12/2001 |
| JP | 2002-091382 | A | 3/2002 |
| JP | 2003-076335 | A | 3/2003 |
| WO | WO 02/03365 | A1 | 1/2002 |
| WO | WO 02/11116 | A | 2/2002 |

* cited by examiner

*Primary Examiner*—My-Chau T Tran
(74) *Attorney, Agent, or Firm*—McDermott Will & Emery LLP

(57) ABSTRACT

A display device according to this invention includes: a display panel (2) having plural pixels configured to display image information; plural driver circuits (10) configured to drive the plural pixels according to a video signal indicative of the image information which is inputted externally, the video signal being a radio signal; and plural wireless input portions (22) each configured to obtain a part of the video signal from the radio signal, wherein the plural driver circuits (10) are each configured to drive a part of the plural pixels according to the part of the video signal obtained by a respective one of the wireless input portions (22).

19 Claims, 12 Drawing Sheets

DRIVER CIRCUIT AND DISPLAY DEVICE

RELATED APPLICATION

This application is a national phase of PCT/JP2004/005599 filed on Apr. 20, 2004,which claims priority from Japanese Application No. 2003-118239 on Apr. 23, 2003, the disclosures of which Applications are incorporated by reference herein. The benefit of the filing and priority dates if the International and Japanese Applications is respectfully requested.

TECHNICAL FIELD

The present invention relates to driver circuits for display devices and, more particularly, to a driver circuit for high-resolution display devices of high display grade including flexible displays (paper-like displays), as well as to a display device provided with such a driver circuit.

BACKGROUND ART

Conventionally, a method such as described below has been generally employed to display image information on the display panel of a display device. Initially, an external device (image information processing device) transmits desired image information and like information in the form of video signals to a display device through wire. The video signals thus transmitted are inputted to a driver circuit (driver LSI) configured to drive pixels included in the display panel of the display device via input signal lines. In turn, the driver circuit drives the pixels according to the video signals thus inputted, thereby displaying the image information on the display panel.

In recent years, such a display device as an electrophoretic display for example has been under research and development for use as a paper-like thin flexible display or electronic paper. A display device with higher definition and higher resolution than conventional liquid display devices or like conventional devices is needed to realize a flexible display of high display grade. To this end, a display device of, for example, active-matrix or passive-matrix type having a very large number of pixels and display electrodes or signal lines is needed. Such a display device has a larger number of semiconductor chips as driver circuits connected to signal lines or scanning lines than a conventional one.

In order to realize the aforementioned high-definition and high-resolution display, about 3000×(4-8 bits) lines are required as the total number of input signal lines connected to the driver circuits for video signals for each of the colors, R (red), G (green) and B (blue) for example. In this case, if, for example, 100 chips are mounted as the driver circuits, the number of input signal lines connected to each driver chip is 30×(4-8 bits)×(R, G and B). Thus, a large number of input signal lines are required for each driver circuit. For this reason, it becomes very difficult to mount and handle individual driver circuits, which raises a large problem that mounting and routing for a whole display device becomes complicated and stiffened.

As the display definition has been rendered high in recent years, the number of output pins is increased to reduce the number of input lines for the purpose of avoiding such a mounting problem, which results in a driver LSI having an increased chip size. An LSI chip can be mounted directly on glass by COG or a like technique. However, if a large chip is used in a flexible display employing a plastic substrate or a like substrate, such a problem is likely that an LSI is broken or a mounting portion is undone.

To avoid complicated routing, video signals are preferably inputted wirelessly rather than through wire. The flexible display, in particular, has to meet the requirement that the display be able to be handled like paper while being conveniently rewritable. For this reason, wireless input of video signals to the flexible display is preferable.

Heretofore, a display device wherein an antenna, receiving circuit, driver circuit, display panel and power source are disposed separately from each other and connected to each other, has been proposed as a display device capable of displaying image information based on video signals wirelessly transmitted to the display device from an external device physically separated from the display device (see, for example, patent literature 1: Japanese Patent Laid-Open Publication No. HEI 5-202358 (pp. 24-25 (0071) and FIGS. 2 and 3). As an example of a display device thus configured, there has been developed for actual use an active-matrix type liquid crystal display device in which plural driver circuits each having multiple input signal lines are disposed behind an antenna/receiving circuit for wireless input from an external device.

FIG. 10 is a conceptual diagram illustrating the configuration of a conventional wireless input display device. In FIG. 10, an external device (not shown) transmits video signals to display device 80. The video signal thus transmitted are received by antenna 81 and receiving portion 82 and then outputted from the receiving portion 82 to driver circuit 84 through input signal lines 83. The driver circuit 84 drives pixels of display panel 85 according to the video signals received. A separately-provided power source portion 86 supplies electric power to different pieces of hardware through power output cable 87 (see patent literature 1).

The display panel 85 has an array substrate formed with, for example, TFTs (switching elements), pixel electrodes, interconnections and the like, and a color filter substrate formed with common electrodes. As described above, color display of image information can be realized by driving the pixels of the display panel 85 with the driver circuit 84.

The configuration of driver circuit 84 will be described below in detail.

FIG. 11 is a conceptual diagram illustrating the configuration of a conventional driver circuit. Like reference characters are used to designate like or corresponding parts throughout FIGS. 11 and 10. As shown in FIG. 11, the driver circuit 84, which is a driver LSI associated with source signal lines of an active-matrix type display panel, comprises a timing generator circuit 88, a sample hold circuit 89, and an output buffer circuit 90, which are electrically interconnected.

RGB video signals are inputted to the driver circuit 84 via input signal lines 83*a*. The sample hold circuit 89 samples RGB video signals inputted within one horizontal scanning period sequentially based on sampling clock signals generated from the timing generator circuit 88. After having been sampled for one horizontal scanning period, the RGB video signals are amplified by the output buffer circuit 90 and then outputted to the signal lines (source lines) on the display panel 85 shown in FIG. 10. On the other hand, the power source portion 86 shown in FIG. 10 supplies the driver circuit 84 with source voltage. Though not shown, a scanning driver circuit (gate driver LSI) outputs horizontal scanning signals to scanning lines (gate lines) on the display panel 85.

In order for such a conventional display device to realize high-definition and high-resolution display comparable to that realized based on wired input of video signals as described above, it is required that the receiving portion 82 be provided with routing of a total number of 3000×(4-8 bits)×(R, G and B) input signal lines 83 and, at the same time, about 100 driver circuit chips 84 each having a number of input signal lines 83*a* as large as 30×(4-8 bits)×(R, G and B) be mounted.

However, it is very difficult to mount and handle these driver circuits 84 individually and, hence, routing for the whole display device 80 is complicated and stiffened. That is, the same problem as with wired input arises even with wireless input. Also, the display device according to patent literature 1 calls for a very high speed receiving circuit LSI for handling high-frequency signals in realizing high-definition and high-resolution display of high display grade based on wireless input. In this case, a large electric power becomes necessary, which raises another problem that a high-capacity power source is needed.

For the reasons stated above, a high-definition and high-resolution display device such as a flexible display is desired to have a driver circuit requiring as simple routing as possible and to be operable at a low electric power, whether through wire or wirelessly the input of image information is made.

Another proposed conventional art is a portable electronic device having a display portion capable of displaying image information obtained in a non-contact manner. For example, patent literature 2 (Japanese Patent Laid-Open Publication No. 2001-344578 (FIGS. 1,2,9,10 and 11)) has proposed a portable electronic device including a combination of a non-contact IC card and a display device, wherein a wireless input/receive portion comprising an antenna part and an RF part, an IC card chip portion having a microprocessor and a power source part configured to obtain electric power from received signals, a CPU including a display driver circuit, and a display device are interconnected and separately disposed. Such a portable electronic device is configured to obtain electric power from signals received by wireless input and hence is capable of realizing wireless transmission and receipt of data and display of data on the IC card side.

However, even the portable electronic device according to patent literature 2 needs to be mounted with multiple driver circuits each having a large number of input signal lines for realizing high-definition and high-resolution display because the positional relation between the wireless input/receive portion, driver circuits and the display device is the same as in the aforementioned patent literature 1. In order to obtain electric power from data signals inputted wirelessly, the portable electronic device according to patent literature 2 is configured to receive signals at only one wireless input portion to turn the signals into electric power. Therefore, it is practically difficult for such a portable electronic device to have a high-capacity power source part adapted to wireless input for driving a high-definition and high-resolution display device.

As described above, the wireless input portion, receiving portion, display driver circuit and display panel are interconnected and separately disposed according to any one of the patent literature 1 and patent literature 2. In order to realize a high-resolution flexible display of high print grade by utilizing these conventional techniques, driver circuits each having a large number of input signal lines need be disposed and mounted in a larger number than ever. In such a case where each driver circuit has a large number of input signal lines, there arises a problem that mounting and handling of such driver circuits becomes very difficult.

In the case of the flexible display, an LSI circuit capable of high-speed receiving operation is needed for wireless input of video signals because the flexible display is of high resolution. Accordingly, the required electric power is increased, which raises a problem that a high-capacity power source becomes necessary.

DISCLOSURE OF INVENTION

The present invention has been made in view of the foregoing circumstances and, therefore, it is an object of the present invention to provide a driver circuit for display panels which allows easy mounting thereof by being not provided with any input signal line, as well as a display device provided with such a driver circuit.

To attain this object, the present invention provides a display device including: a display panel having plural pixels configured to display image information; and plural driver circuits configured to drive the plural pixels according to a video signal indicative of the image information which is inputted externally, the video signal being a radio signal; the display device comprising: plural wireless input portions each configured to obtain a part of the video signal from the radio signal, wherein the plural driver circuits are each configured to drive a part of the plural pixels according to the part of the video signal obtained by the wireless input portions.

In the display device according to the above-described invention, preferably, each of the plural driver circuits has a respective one of the wireless input portions and is configured to drive the part of the plural pixels according to the part of the video signal obtained by the respective one of the wireless input portions.

In the display device according to the above-described invention, preferably, the radio signal is an RF signal; and the wireless input portions are configured to demodulate the RF signal. In the display device according to the above-described invention, preferably, the wireless input portions of respective of the plural driver circuits are each configured to receive a respective one of different frequencies.

In the display device according to the above-described invention, preferably, each of the driver circuits further comprises: a storage portion configured to store the part of the video signal therein; a signal transmitting portion configured to modulate the part of the video signal to generate a transmission signal; and a wireless output portion configured to wirelessly output the transmission signal generated by the signal transmitting portion.

In the display device according to the above-described invention, preferably, the driver circuits are each assigned identification information, and the wireless input portion configured to obtain the part of the video signal from the radio signal based on the identification information.

In the display device according to the above-described invention, preferably, the driver circuits are each a large scale integrated circuit.

In the display device according to the above-described invention, preferably, the driver circuits each comprise a thin film device circuit including a thin film transistor.

According to the present invention, there is provided an information processing system comprising: a display device including a display panel having plural pixels configured to display image information, and plural driver circuits configured to drive the plural pixels according to a video signal indicative of the image information which is inputted externally; and an image information processing device configured to transmit the video signal as a radio signal, wherein: the display device includes plural wireless input portions each configured to obtain a part of the video signal from the radio signal; and the plural driver circuits are each configured to drive a part of the plural pixels according to the part of the video signal obtained by the wireless input portions.

In the information processing system according to the above-described invention, preferably, each of the plural driver circuits has a respective one of the wireless input portions and is configured to drive the part of the plural pixels according to the part of the video signal obtained by the respective one of the wireless input portions.

In the information processing system according to the above-described invention, preferably, the image information processing device is configured to divide the radio signal into plural radio signals and transmit the plural radio signals at a respective one of different carrier frequencies; and the wireless input portions of respective of the plural driver circuits are each configured to receive a respective one of different frequencies.

In the information processing system according to the above-described invention, preferably, the image information processing device is configured to transmit a radio signal containing identification information for identifying each of the driver circuits; and the wireless input portion is configured to obtain the part of the video signal from the radio signal based on the identification information.

According to the present invention, there is provided a display device driver circuit for driving a pixel configured to display image information according to a video signal indicative of the image information which is inputted externally, the video signal being a radio signal, the driver circuit comprising a wireless input portion configured to obtain a part of the video signal from the radio signal, the driver circuit being operative to drive the pixel according to the part of the video signal obtained by the wireless input portion.

In the driver circuit according to the above-described invention, preferably, the radio signal is an RF signal; and the wireless input portion is operative to demodulate the RF signal.

Preferably, the driver circuit according to the above-described invention further comprises a power source portion configured to convert the received radio signal to electric power energy.

Preferably, the driver circuit according to the above-described invention further comprises: a storage portion configured to store the part of the video signal; a signal transmitting portion configured to modulate the part of the video signal to generate a transmission signal; and a wireless output portion configured to wirelessly output the transmission signal generated by the signal transmitting portion.

Preferably, the driver circuit according to the above-described invention is assigned identification information, wherein the wireless input portion is configured to obtain the part of the video signal from the radio signal based on the identification information.

Preferably, the driver circuit according to the above-described invention comprises a thin film device circuit including a thin film transistor.

The foregoing and other objects, features and advantages of the present invention will become apparent from the reading of the following detailed description of the preferred embodiments with reference to the accompanying drawings.

BEST MODE FOR CARRYING OUT THE INVENTION

Hereinafter, embodiments of the present invention will be described in detail with reference to the drawings.

Embodiment 1

Figure 1:
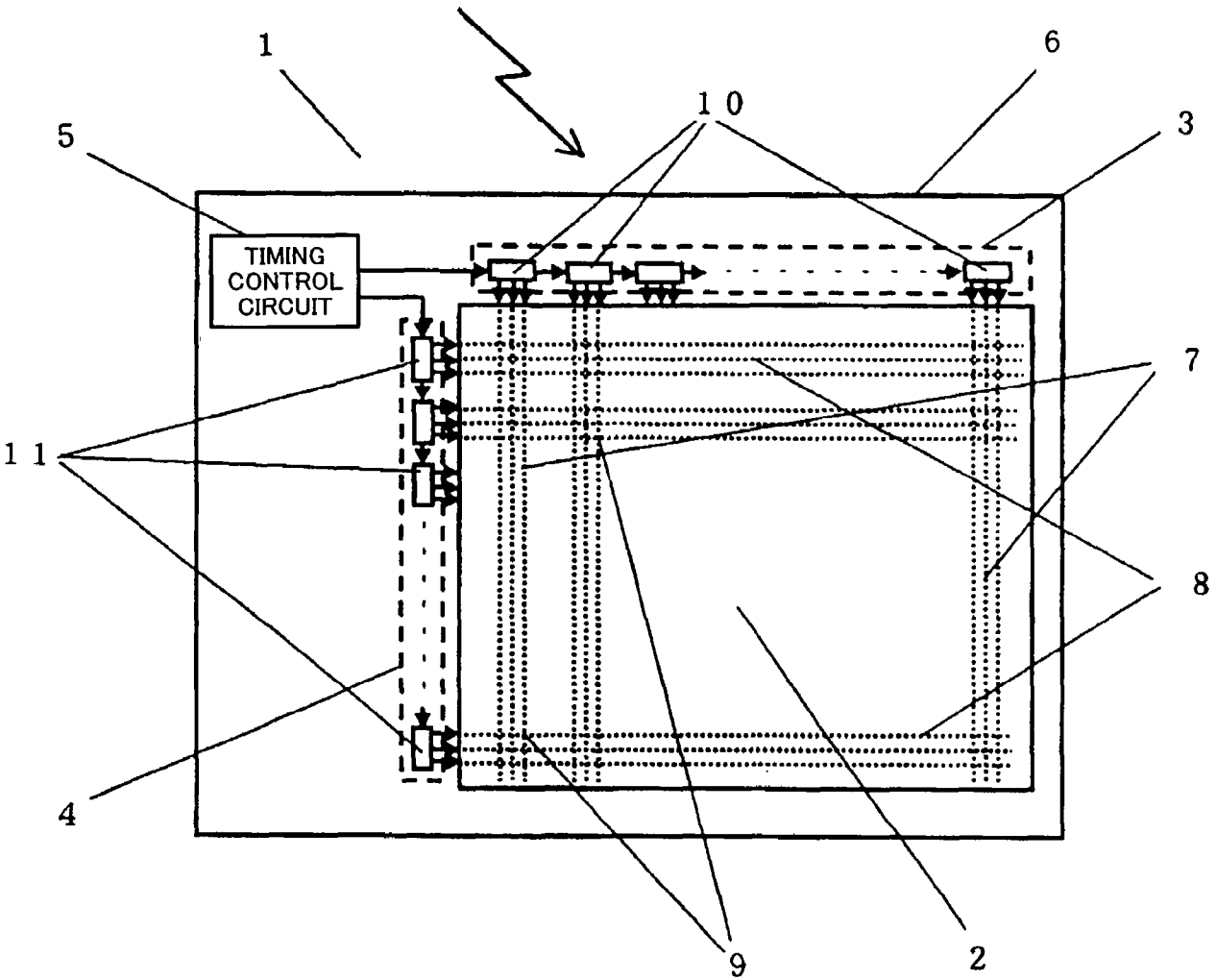
FIG. 1 is a conceptual diagram illustrating a configuration of a display device according to embodiment 1 of the present invention.

FIG. 1 is a conceptual diagram illustrating a configuration of a display device according to embodiment 1 of the present invention. As shown in FIG. 1, display device 1 comprises, at least, an active-matrix type display panel 2 configured to display image information, a source driver portion 3 configured to output video signals within one horizontal scanning period to drive pixels, a gate driver portion 4 configured to output horizontal scanning signals sequentially, and a timing control circuit 5 configured to generate clock signals and horizontal and vertical synchronizing signals and then output them to the source driver portion 3 and gate driver portion 4.

The display panel 2 may comprise, for example, an electrophoretic display panel having an electrophoretic display material interposed between an array substrate 6 and a non-illustrated color filter substrate which are positioned to face each other, the electrophoretic display panel being of the memory display type. The display panel 2 may comprise any other display panel than the electrophoretic display panel which can be used as a flexible display.

In the display panel 2 a plurality of signal lines (source lines) 7 connected to the source driver portion 3 and a plurality of scanning lines (gate lines) 8 connected to the gate driver portion 4 are arranged to intersect each other. Though not shown, a TFT (switching element) fabricated by the low-temperature polysilicon technology and a pixel electrode comprising a transparent electrode, an Al reflective electrode or a like electrode are provided at each point of intersection 9. Thus, each of the pixels defined by the signal lines 7 and the scanning lines 8 is provided with a switching element and a pixel electrode. Also, though not shown, common electrodes are formed on the color filter substrate opposed to the array substrate 6.

In the source driver portion 3 are disposed plural signal-side driver circuits 10 configured to output RGB video signals for driving the pixels, the RGB video signals each forming part of a video signal indicative of image information. In this embodiment about 100 driver LSIs (large scale integrated circuits), each of which has a small chip form, are disposed as the driver circuits 10 for high-precision and high-resolution display. Signal output terminals (not shown) of these driver circuits 10 are each connected to a respective one of the signal lines 7.

In the gate driver portion 4 are disposed plural scanning-side driver circuits (driver LSIs) 11. Scanning signal output terminals (not shown) of these driver circuits 11 are each connected to a respective one of the scanning lines 8.

In the display device 1 thus configured, the timing control circuit 5 outputs a control signal to each of the source driver portion 3 and the gate driver portion 4 according to a video signal inputted externally. Thus, the driver circuits 11 of the gate driver portion 4 output scanning signals to the scanning lines 8 to turn on the switching elements of respective pixels sequentially, while on the other hand the driver circuits 10 of the source driver portion 3 input video signals to the pixels sequentially via the signal lines 7 in a manner timed to the operation of the driver circuits 11. As a result, the pixels are driven to display image information on the display panel 2.

Description will be made of a detailed configuration of each of the signal-side driver circuits 10 included in the source driver portion 3.

Figure 2:
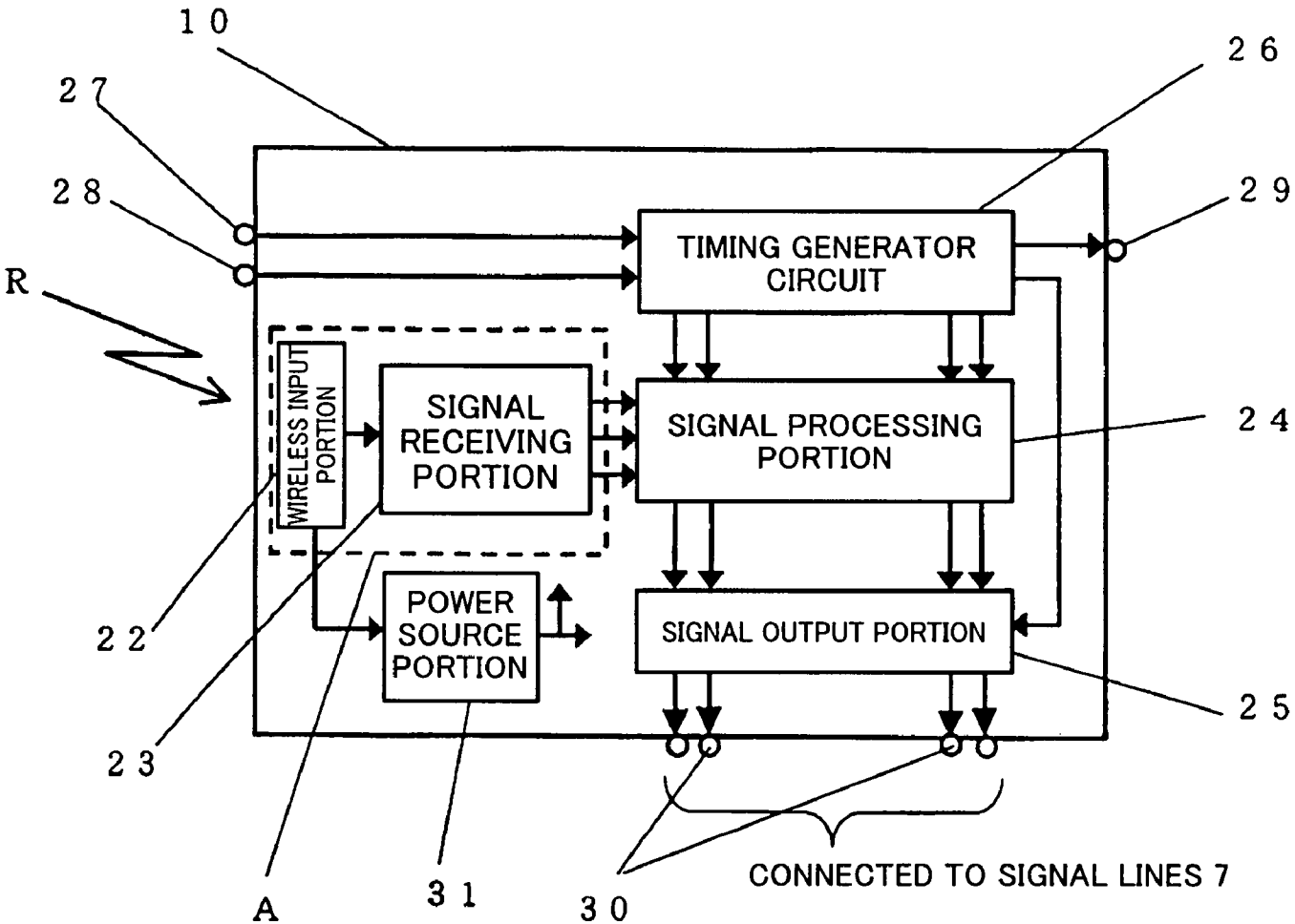
FIG. 2 is a block diagram illustrating the configuration of a driver circuit included in a source driver portion of the display device according to embodiment 1 of the present invention.

FIG. 2 is a block diagram illustrating the configuration of each driver circuit 10 included in the source driver portion 3 of the display device 1 according to embodiment 1 of the present invention.

As shown in FIG. 2, driver circuit 10 includes: a radio signal receiving portion A having a wireless input portion 22 for inputting video signals which are radio signals R and a signal receiving portion 23; a signal processing portion 24 configured to process the video signals outputted from the radio signal receiving portion A; and a timing generator circuit 26 and a signal output portion 25 which are connected to the signal processing portion 24.

The driver circuit 10 further includes a power source portion 31, to be described later, connected to the wireless input portion 22.

The wireless input portion 22 of the driver circuit 10 thus configured receives an RF signal (radio frequency signal) indicative of image information transmitted from an image information processing device (not shown) as an external device, the RF signal being a radio signal R resulting from sequential and/or parallel modulation of carrier frequency. In this case the wireless input portion 22 receives a part of the RF signal according to one predetermined received frequency and then outputs the received signal to the signal receiving portion 23.

The signal receiving portion 23 demodulates the received signal inputted from the wireless input portion 22 and then outputs the demodulated signal as received data forming part of the RGB video signal to the signal processing portion 24. The signal processing portion 24, in turn, performs signal processing on the received data inputted and then outputs the processed data as signal data to the signal output portion 25.

To the timing generator circuit 26 are inputted a basic clock signal sent thereto from the timing control circuit 5 via a clock signal terminal 27, and horizontal and vertical synchronizing signals sent thereto from the timing control circuit 5 via a horizontal and vertical synchronizing signal input terminal 28. The timing generator circuit 26 outputs a synchronizing signal to other driver circuit 10 located adjacent to the driver circuit 10 of concern via a synchronizing signal output terminal 29 and an output clock signal to the signal output portion 25. On the other hand, a sample hold circuit (not shown) provided in the signal processing portion 24 sequentially samples the aforementioned received data inputted within one horizontal scanning period according to the clock signal outputted from the timing generator circuit 26. Thereafter, the received data thus sampled is outputted as signal data from the sample hold circuit to the signal output portion 25. In turn, an output buffer circuit (not shown) provided in the signal output portion 25 amplifies the signal data. The signal data thus amplified is outputted to the signal lines 7 of the display panel 2 via signal output terminals 30.

The power source portion 31 obtains the received signal from the wireless input portion 22 and converts the received signal to source voltage (energy) to obtain electric power required to operate the inside components of the driver circuit 10.

As described above, the driver circuit 10 receives the input of a video signal wirelessly and outputs signal data to the display panel 2.

Figure 3:
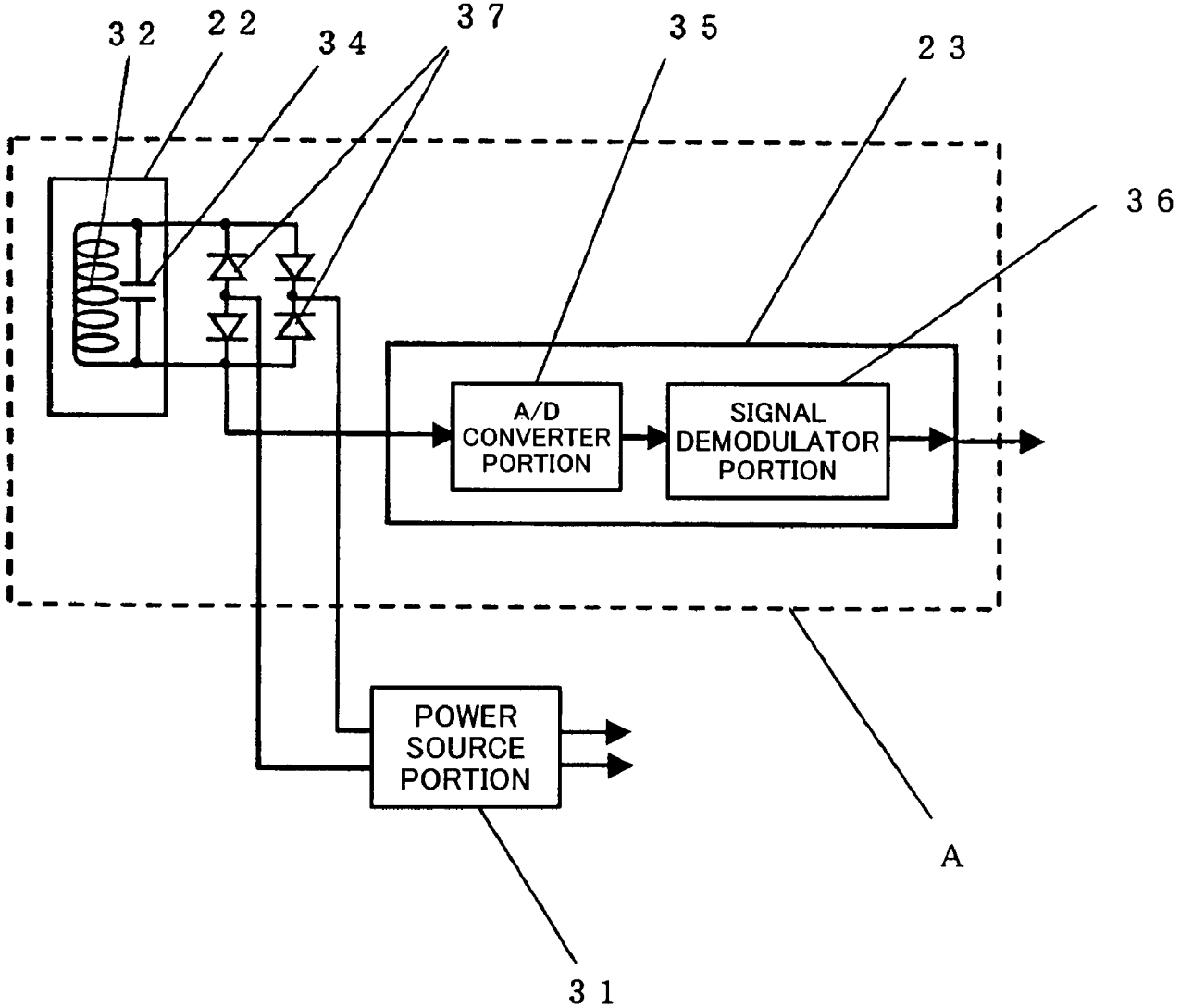
FIG. 3 is a block diagram illustrating a detailed configuration including a radio signal receiving portion and a power source portion.

With reference to FIG. 3, description will be made of a detailed configuration including the radio signal receiving portion A provided with the above-described wireless input portion 22 and signal receiving portion 23, and the power source portion 31.

As shown in FIG. 3, the wireless input portion 22 of the radio signal receiving portion A is formed into an antenna comprising coil 32 and capacitor 34. However, the wireless input portion 22 is not limited to this form but may be in any form which is capable of wireless input. The wireless input portion 22 detects and tunes the RF signal indicative of image information which has resulted from sequential and/or parallel modulation of the carrier frequency and transmitted wirelessly from the image information processing device.

The signal receiving portion 23 includes an A/D converter portion 35 and a signal demodulator portion 36. The received analog signal obtained according to one predetermined received frequency by the wireless input portion 22 is converted to a digital signal by the A/D converter portion 35 of the signal receiving portion 23. The signal demodulator portion 36 demodulates the digital signal to obtain the received data comprising an RGB video signal is obtained. The received data thus obtained is outputted from the signal receiving portion 23 to the signal processing portion 24.

Also, as shown in FIG. 3, a rectifier circuit 37 is provided between the wireless input portion 22 and the power source portion 31. The rectifier circuit 37 rectifies the received signal inputted via the wireless input portion 22 and then outputs the received signal thus rectified to the power source portion 31.

The power source portion 31 converts the received signal outputted from the wireless input portion 22 to electric power energy as d.c. source voltage (VDD, VSS) by using a non-illustrated smoothing capacitor and then supplies the electric power energy to each inside component of the driver circuit 10.

The power source portion 31 is not limited to the above-described configuration but may be of any configuration which is capable of converting the received signal outputted from the wireless input portion 22 to electric power energy.

By thus causing the power source portion 31 in the driver circuit 10 to generate electric power for driving the driver circuit 10, the power source portions 31 can cooperatively supply the electric power required to drive the whole display device 1. It is needless to say that such a configuration is possible that a power source portion is provided within the driver circuit 10 for supplying electric power energy to the driver circuit 10 and the power source portion 31 assists the power source portion in supply of electric power energy.

Since the driver circuit 10 inputs the video signal wirelessly as described above, an input signal line for the video signal outputted from an external device becomes unnecessary. For this reason, the mounting of the driver circuit 10 becomes easy. As a result, the mounting portion of the driver circuit 10 can be rendered compact in the paper-like display device 1 capable of high-definition and high-resolution display. What is more, the LSI chip constituting the driver circuit 10 has a small form and hence is difficult to break. As a result, display failure of the display panel 2 is not likely to occur even when the whole display device 1 is bent.

Also, each driver circuit 10 obtains only part of image information required for the display device 1 by wireless input. Thus, the source driver portion 3, as a whole, obtains the whole of the image information. With such a feature, the signal frequency handled by each driver circuit 10 can be lowered and, therefore, electric power of the same level as required by a conventional driver circuit not adapted to high-definition and high-resolution display is sufficient for the driver 10.

As described above, each driver circuit 10 receives a part of the received signal, which is an RF signal (radio frequency signal) indicative of image information wirelessly transmitted thereto and resulting from sequential and/or parallel modulation of the carrier frequency, from the external image information processing device (not shown) using wireless input portion 22 of which the received frequency is different from that of the wireless input portion of other driver circuit 10. Each of the driver circuits 10 obtain part of the image information from the part of received signal using the signal receiving portion 23 and then outputs the part of image information to a respective one of the signal lines 7 of the display panel 2. The pixels of the display panel 2 are driven by output signals from respective driver circuits 10 of the source driver portion 3 and scanning signals from respective driver circuits 11 of the gate driver portion 4, whereby desired image information is wholly displayed on the display panel 2.

By thus dividedly inputting the received signal required for the image information to be wholly displayed to the driver circuits, it is possible to realize a display device capable of high-definition and high-resolution display at a low electric power.

Figure 4:
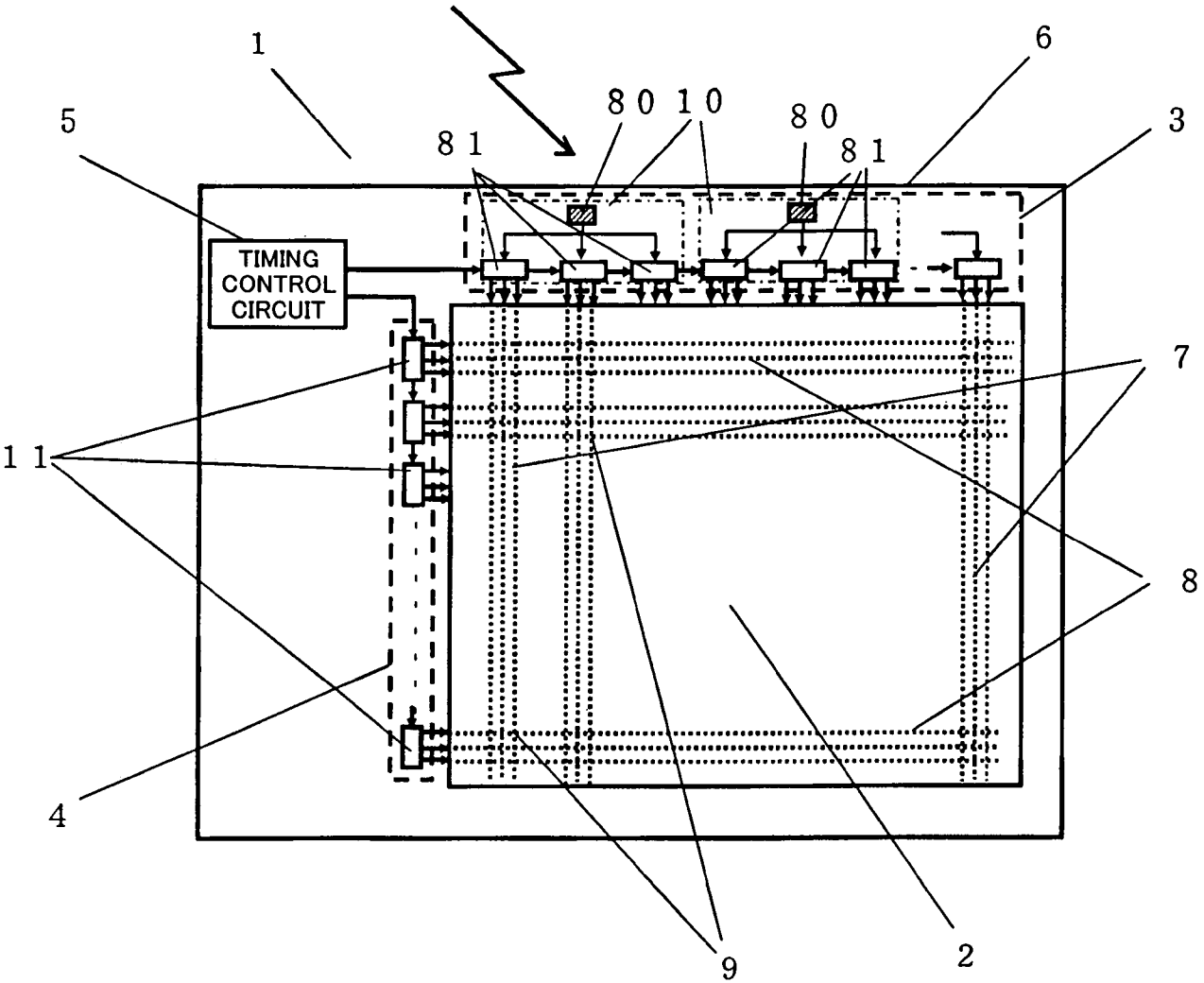
FIG. 4 is a conceptual diagram illustrating another configuration of the display device according to embodiment 1 of the present invention.

In the case of driver circuit 10 according to the present embodiment, both the wireless input portion 22 and the signal output portion 25 for driving pixels are incorporated in one LSI. However, the present invention is not limited to this configuration. For example, as shown in FIG. 4, driver circuit 10 may be formed by connecting an LSI 80 including at least a wireless input portion (not shown) and a signal receiving portion (not shown) to plural LSIs 81 each including at least a signal output portion (not shown). FIG. 4 shows a configuration wherein driver circuits 10 are formed on a block basis, each driver circuit 10 comprising one block having one LSI 80 and three LSIs 81. The configuration has a smaller number of routed wires than a conventional configuration having one wireless receiving circuit, though the number of routed wires is larger than that of the configuration described with reference to FIG. 1. Further, shared processing on a block basis provides the effect of reducing the load on the wireless circuit.

Variation 1

Figure 5:
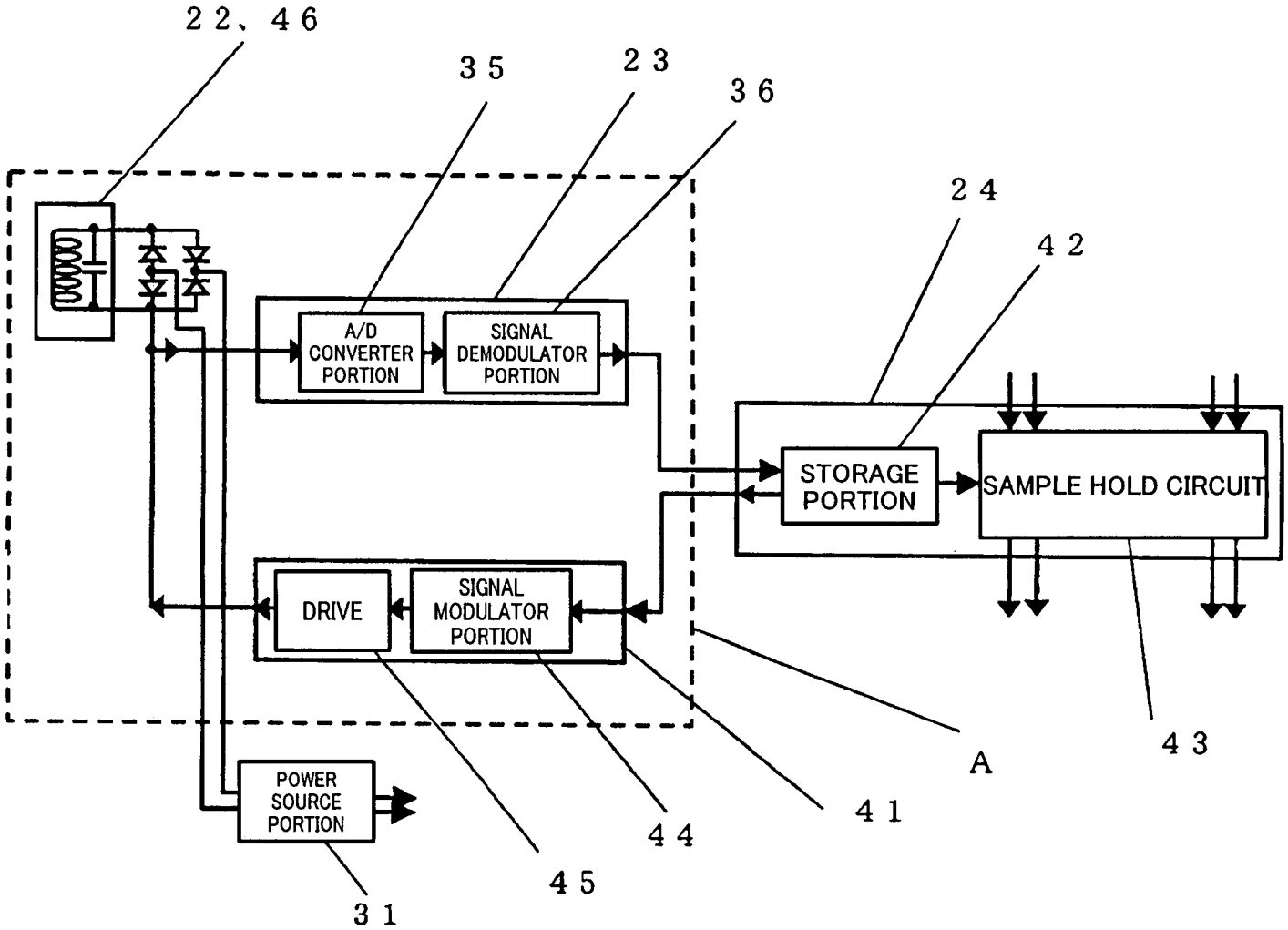
FIG. 5 is a block diagram illustrating a partial configuration of a driver circuit included in a source driver portion of a display device according to variation 1 of embodiment 1 of the present invention.

FIG. 5 is a block diagram illustrating a partial configuration of a driver circuit included in a source driver portion of a display device according to variation 1 of embodiment 1 of the present invention. Like reference characters are used to designate like or corresponding parts throughout FIG. 5 and FIGS. 2 and 3 illustrating the present embodiment.

The display device according to variation 1 is different from the display device shown in FIGS. 1 and 3 in that the display device includes a signal transmitting portion 41 in radio signal receiving portion A of wireless input driver circuit 10, a storage portion (buffer memory) 42 in signal processing portion 24, and a wireless output portion 46.

The storage portion 42 is configured to store received data, which is video signal data outputted from the signal receiving portion 23. Sample hold circuit 43 in the signal processing portion 24 performs predetermined signal processing on the received data inputted from the storage portion 42.

The signal transmitting portion 41 includes a signal modulator portion 44 and a drive 45. Video signal data outputted from the storage portion 42 of the signal processing portion 24 is inputted as transmitted data to the signal transmitting portion 41. The signal modulator portion 44 of the signal transmitting portion 41 modulates the transmitted data inputted thereto into a transmission signal, which in turn is amplified by the drive 45 and then wirelessly outputted as part of image information from the wireless output portion 46 which is an antenna also serving as the wireless input portion 22. The wireless output portion 46 may be provided separately from the wireless input portion 22 without sharing the antenna.

Each driver circuit 10 is assigned its own identification information such as an identification number and stores ID code data indicative of its own identification information in a predetermined storage portion. By outputting such ID code data together with a video signal when the image information processing device or other display device outputs the video signal, the video signal can be properly transmitted to and received from the image information processing device or other display device and the driver circuit 10 identified by the specified ID code data. Also, the image information processing device can transmit image information to only the specific driver circuit 10 identified by ID code data specified and update only an associated portion of screen. Thus, the time and electric power required for updating of an image can be reduced. This effect is advantageous particularly to a non-volatile display system such as an electrophoretic display system.

Variation 2

Figure 6:
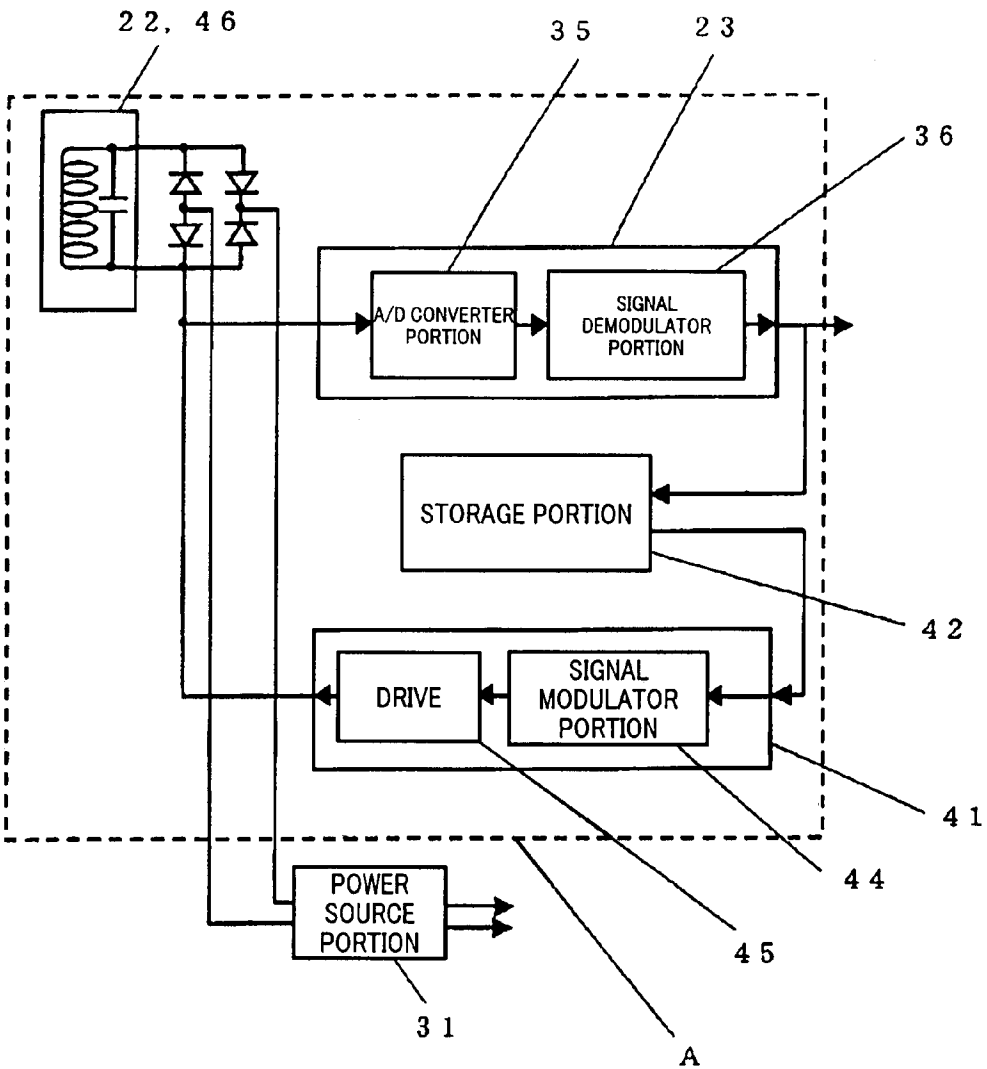
FIG. 6 is a block diagram illustrating a partial configuration of a driver circuit included in a source driver portion of a display device according to variation 2 of embodiment 1 of the present invention.

FIG. 6 is a block diagram illustrating a part of another configuration of a driver circuit included in a source driver portion of a display device according to embodiment 1 of the present invention. Like reference characters are used to designate like or corresponding parts throughout FIG. 6 and FIG. 5 illustrating variation 1.

The driver circuit included in the display device according to variation 1 includes the storage portion in the signal processing portion, as shown in FIG. 5. On the other hand, a driver circuit included in the display device according to variation 2 includes storage portion 42 in radio signal receiving portion A.

In the driver circuit of the display device according to variation 2, signal receiving portion 23 outputs received data, which is video signal data, to signal processing portion 24 while causing storage portion 42 of driver circuit 10 to store the received data therein.

Signal transmitting portion 41 inputs thereto the video signal data stored in the storage portion 42 as transmitted data, modulates and amplifies the transmitted data, and outputs a transmission signal to wireless output portion 46. The wireless output portion 46, in turn, wirelessly outputs the transmission signal as part of image information.

As described above, the driver circuit of the display device according to variation 1 or 2 can read out video signal data stored in the storage portion provided within the driver circuit as transmitted data and output part of image information wirelessly (in the form of RF signal). Thus, it becomes possible to wirelessly output the image information shared for display by driver circuits to the image information processing device or other display device.

In the above-described embodiment, each of driver circuit 10 of source driver portion 3 and driver circuit 11 of gate driver portion 4 has been described to comprise an LSI (large scale integrated circuit). Such a driver circuit may comprise a thin film device circuit including at least a TFT (thin film transistor) formed by the thin film growth process such as the low-temperature polysilicon technology. With the thin film growth process for forming TFTs as switching elements, pixel electrodes, interconnections and the like on array substrate 6, it is possible to form at least driver circuits 10 and 11 and array substrate 6 by one process step.

Figure 12:
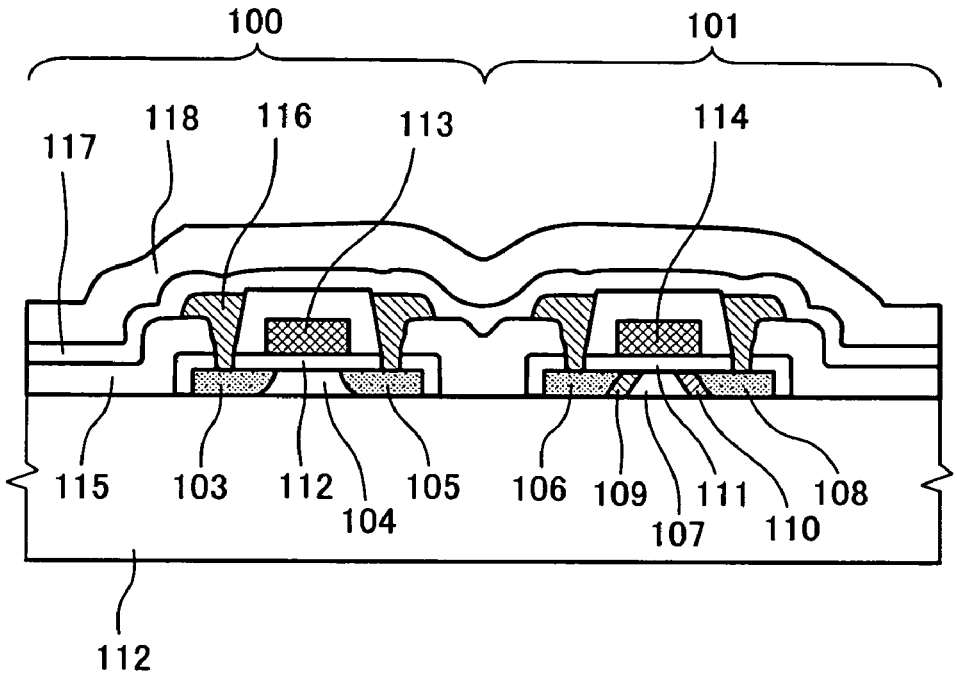
FIG. 12 is a sectional view illustrating the construction of a CMOS transistor fabricated by the low-temperature polysilicon technology.
Figure 13:
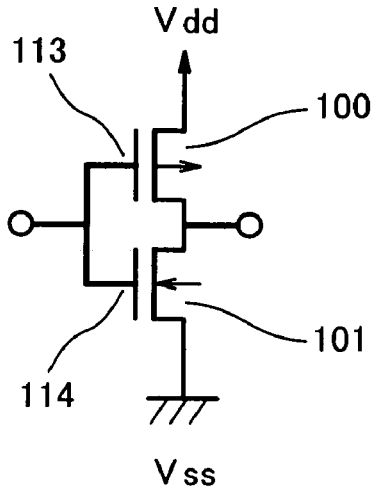
FIG. 13 is a circuit diagram of an inverter serving as a basis for a logic circuit forming a driver circuit.

FIG. 12 is a sectional view illustrating the construction of a CMOS transistor fabricated by the low-temperature polysilicon technology. As shown in FIG. 12, the CMOS transistor comprises a p-type transistor 100 and an n-type transistor 101. The CMOS transistor shown in FIG. 12 includes, on an insulating substrate 102 such as of glass, source 103 and drain 105 formed by doping a silicon thin film rendered polycrystalline by excimer laser annealing with boron, source 106 and drain 108 doped with phosphorus, and channel layers 104 and 107. In the n-type transistor 101, LDD regions 109 and 110, which are doped lightly, are formed on the insulating substrate 102. Gate oxide films 111 and 112 each comprising silicon nitride and gate electrodes 113 and 114 each comprising stacked films of titanium and aluminum, are stacked thereon. An insulating film 115 has openings in which lead electrodes 116 contacting source and drain are formed. Cap layers 117 and 118 are stacked to cover these components. By connecting such p-type transistor and n-type transistor to each other, each of driver circuits 10 and 11 according to the present invention can be realized which comprises a thin film device circuit including a thin film transistor. FIG. 13 is a circuit diagram of an inverter serving as a basis for a logic circuit forming driver circuit 10,11 thus realized.

If such a driver circuit thus formed using a TFT includes an inductance provided by forming each of gate and source wires into a plane coil in addition to a transistor and capacitor as used in a liquid crystal display, the above-described driver circuit for the display device according to the present embodiment can be realized.

Meanwhile, the carrier mobility of a TFT is as low as about ⅕ of that of an LSI and hence has a drawback that it cannot accommodate to high frequencies. However, the present invention can lower a frequency to be handled by the provision of plural driver circuits. Therefore, the present invention has an advantage that driver circuits each using a TFT can be easily realized even in a high-definition display. As a result, it becomes possible to form a display device which does not need any wiring connecting to outside by the TFT process only.

Embodiment 2

Figures 7A, 7B:
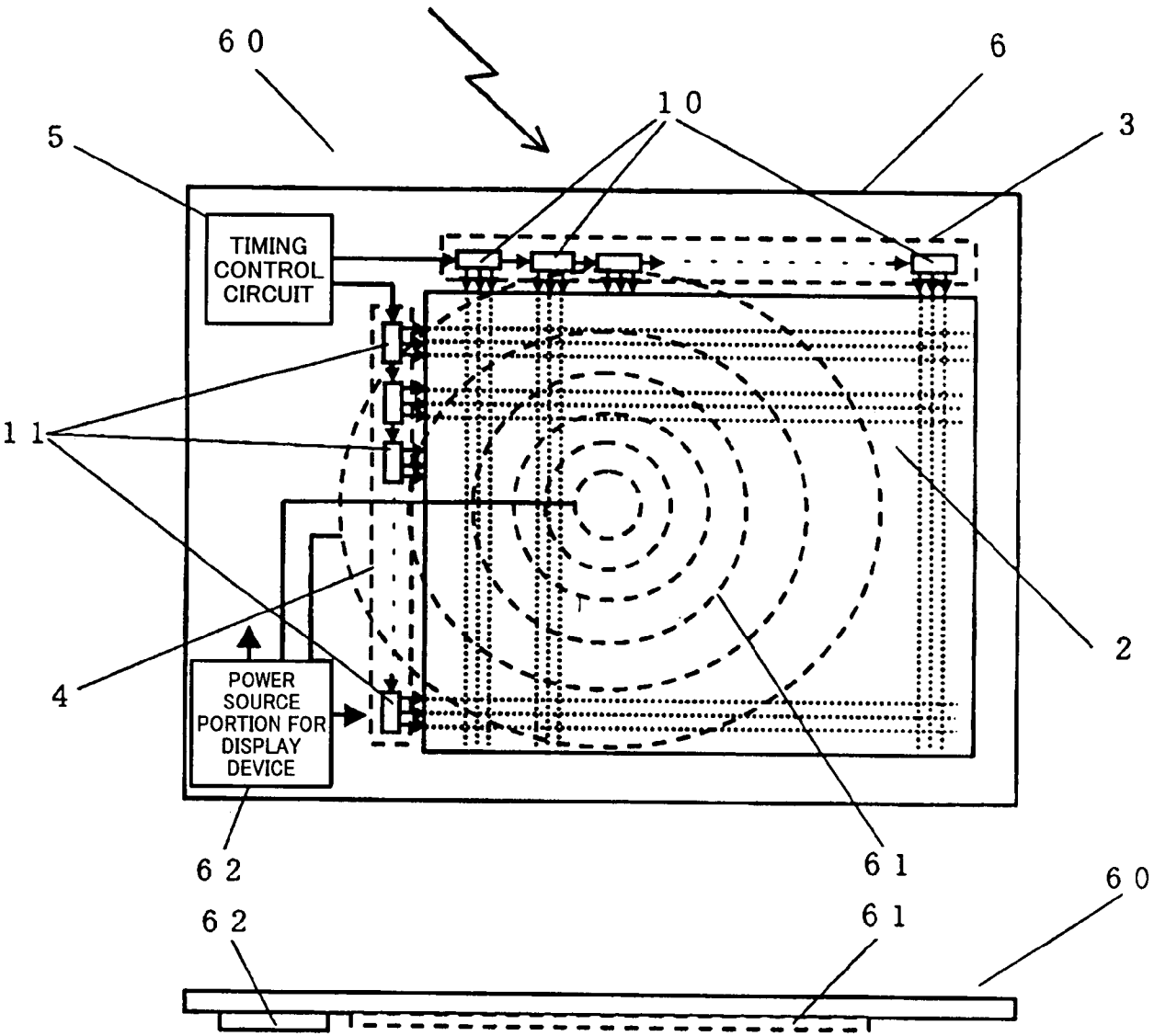
FIG. 7A is a plan view illustrating a configuration of a display device according to embodiment 2 of the present invention.
FIG. 7B is a sectional view illustrating a configuration of the display device according to embodiment 2 of the present invention.

FIG. 7A is a plan view illustrating a configuration of a display device according to embodiment 2 of the present invention and FIG. 7B is a sectional view of the configuration. As shown in FIGS. 7A and 7B, a wireless input antenna portion 61 for display device and a power source portion 62 for display device are provided on the reverse side of array substrate 6 included in a display device 60. A received signal obtained via the wireless input antenna portion 61 is converted to electric power energy (source voltage) by the power source portion 62.

In the display device 60 thus configured, the power source portion 62 for display can supply electric power to the driver circuits 10 and 11 and the like or assist in the supply of electric power thereto, thereby driving the driver circuits 10 and 11 and the like.

It should be noted that like reference characters are used to designate like or corresponding parts throughout embodiment 2 and embodiment 1 to omit description thereof.

In the case of display device 60 according to embodiment 2, a received signal is obtained through the wireless input antenna portion 61 for display device and then converted to source voltage by the power source portion 62 for display device, whereby insufficient supply of electric power to the display device 60 can be supplemented. As a result, the display device capable of wireless input and output can be operated stably. Particularly, wireless output requires large power consumption and hence is highly likely to make the operation of the display device unstable. In view of this, stabilizing the operation of the display device is considered to be of great significance.

Description will be made of an information processing system including display device 60 according to embodiment 2.

Figure 8:
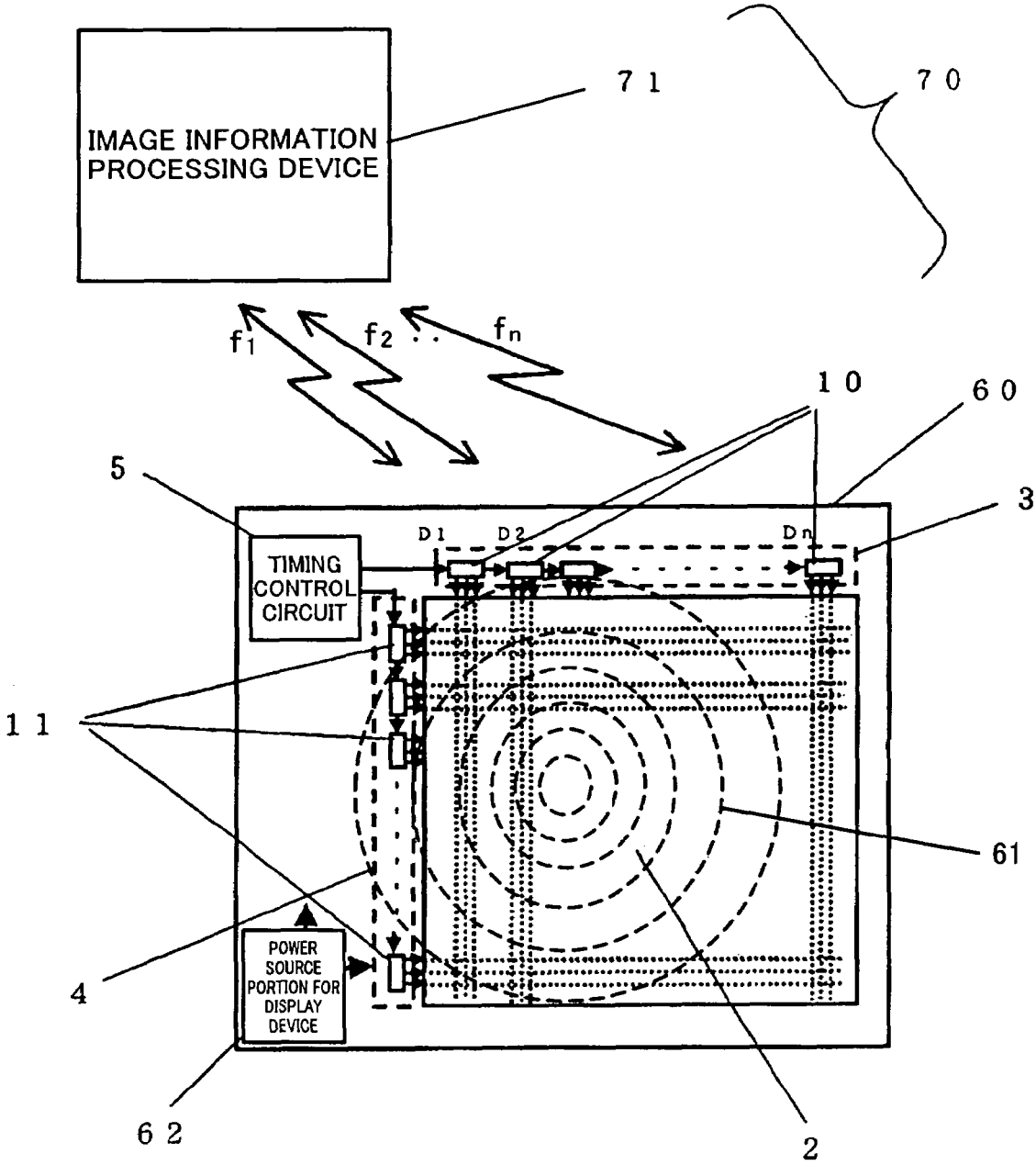
FIG. 8 is a conceptual diagram illustrating a configuration of an information processing system including the display device according to embodiment 2 of the present invention.

FIG. 8 is a conceptual diagram illustrating a configuration of an information processing system including the display device 60 according to embodiment 2 of the present invention. Like reference characters are used to designate like or corresponding parts throughout FIG. 8 and FIG. 7.

As shown in FIG. 8, information processing system 70 includes image information processing device 71 and display device 60.

As described above, the power source portion 62 for display supplies electric power to the driver circuits 10 and 11 and the like or assists in the supply of electric power thereto, thereby driving the driver circuits 10 and 11 and the like.

Driver circuits 10 included in source driver portion 3 receive image information modulated sequentially and/or in parallel by carrier frequencies f1, f2, . . . , fin and wirelessly transmitted from the image information processing device 71. For convenience of description, the driver circuits 10 for receiving respective image information items transmitted by carrier frequencies f1, f2, . . . , fn will be referred to as driver circuits D1, D2, . . . , Dn, respectively. Pixels of display panel 2 are driven by output signals which are video signals from the driver circuits D1, D2, . . . , Dn and scanning signals from driver circuits 11, thereby to display the whole of desired image information on the display panel 2.

Each of the driver circuits D1, D2, . . . , Dn capable of wireless output in this way reads out video signal data stored in a storage portion provided therein as transmitted data. Then, each of the driver circuits D1, D2, . . . , Dn modulates the transmitted data into a respective one of the carrier frequencies f1, f2, . . . , fn and outputs part of the image information wirelessly. Thus, the display device 60 can transmit the whole or part of high-definition image information to the image information processing device 71 or other display device.

In the case of the above-described information processing system 70, wireless communication of image information between the image information processing device 71 and the display device 60 becomes possible by the image information processing device 71 and display device 60 wirelessly transmitting and receiving video signals obtained by sequential and/or parallel modulation of image data into carrier frequencies to and from each other.

The image information processing device 71 is a device comprising, at least, means of generating image information to be displayed or obtaining the image information externally, and means of wirelessly transmitting image information. For example, either a mobile device such as a personal computer or a PDA or other device such as an information transmitting device can be used as the image information processing device 71. The display device 60 receives image information wirelessly outputted from the image information processing device 71, thereby realizing the information processing system 70 which enables the viewer to view a high-definition screen at hand.

It is to be noted that the image information processing device 71 and the display device 60 are not necessarily independent of each other but may be components of a single device. For example, among various conventional mobile devices, there is one which employs a foldable flexible substrate for electrical connection between, for example, a display panel and other components in order to reduce its size. In such a case highly complicated routing of wires is necessary. Such complicated routing becomes unnecessary if a mobile device includes display device 60 and image information processing device 71 for transmitting image information to the display device 60, which devices 60 and 71 are configured to transmit and receive image information to and from each other. As a result, the mobile device can be reduced in size and simplified in structure, which leads to a reduction in cost.

Figure 9:
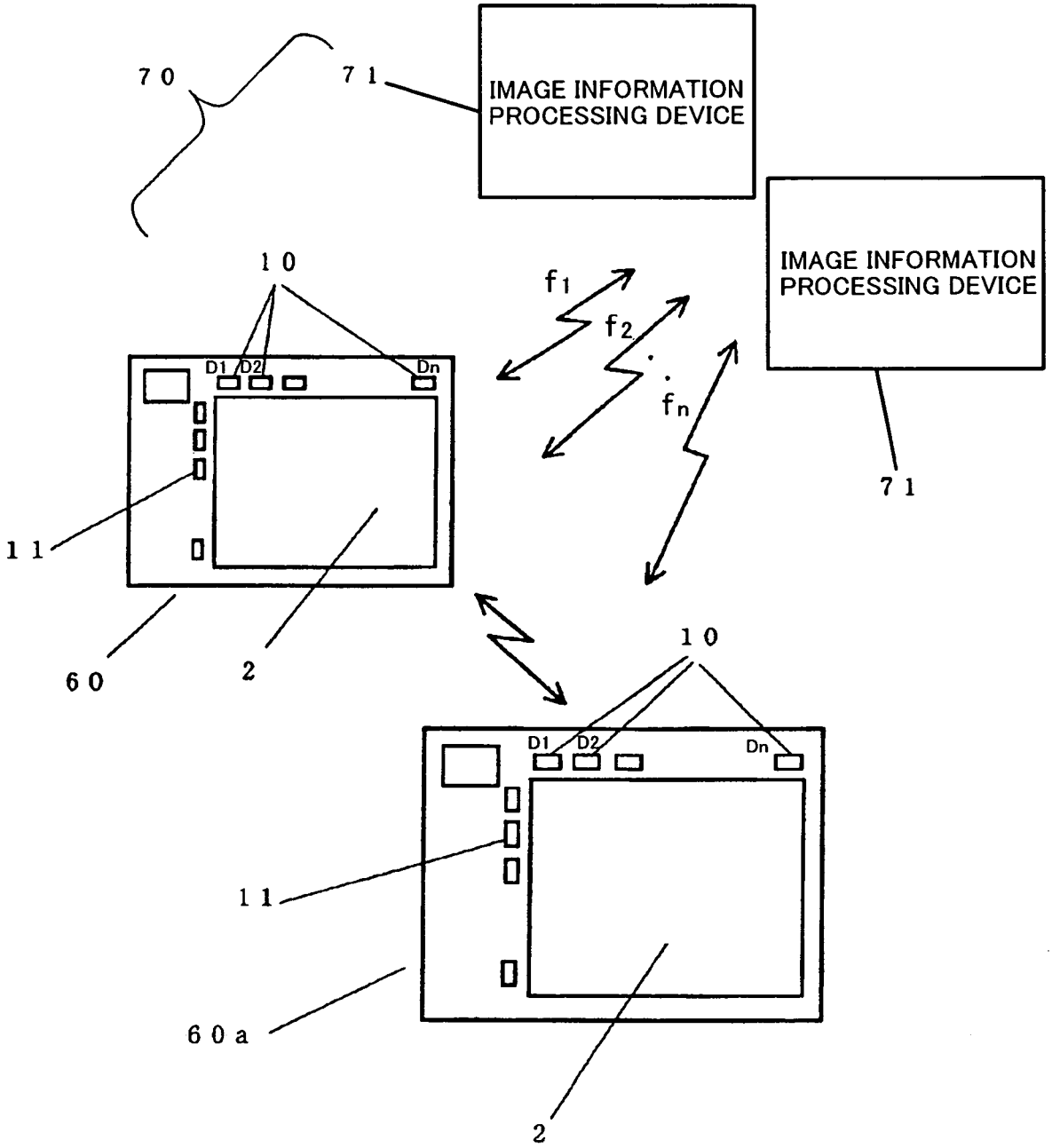
FIG. 9 is a conceptual diagram illustrating another configuration of the information processing system including the display device according to embodiment 2 of the present invention.
Figure 10:
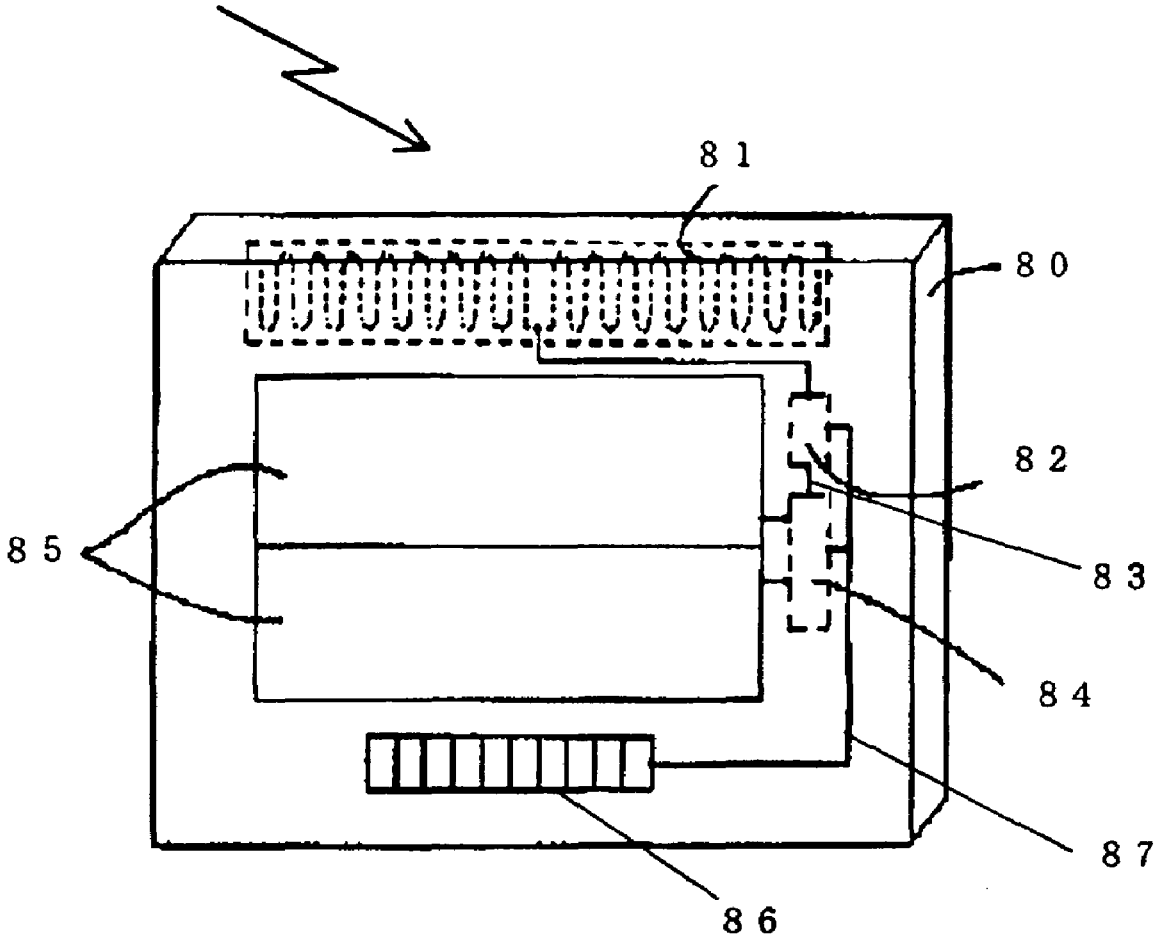
PRIOR ART FIG. 10
FIG. 10 is a conceptual diagram illustrating a configuration of a conventional wireless input display device.
Figure 11:
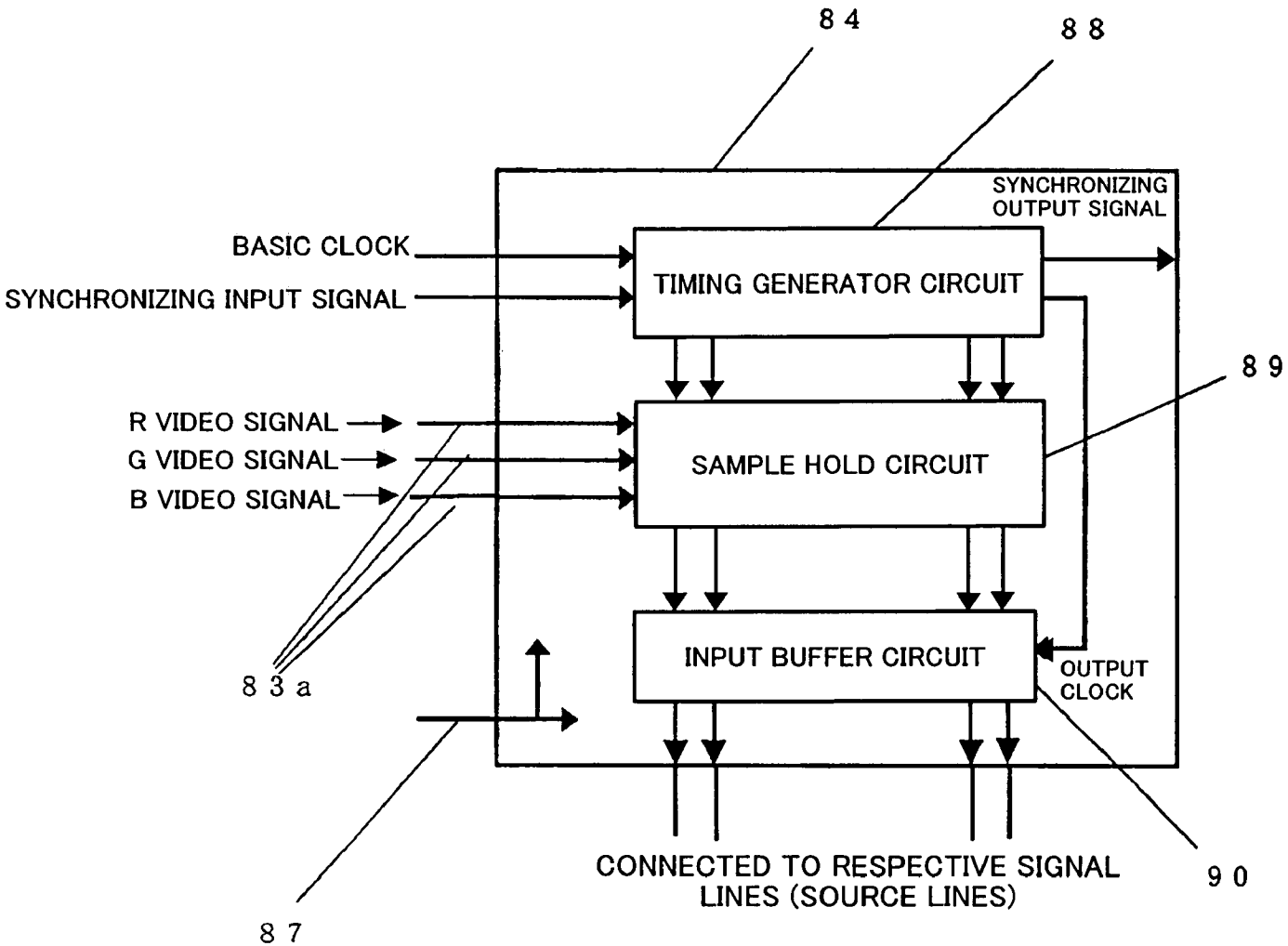
PRIOR ART FIG. 11
FIG. 11 is a conceptual diagram illustrating a configuration of a conventional driver circuit.

FIG. 9 is a conceptual diagram illustrating another configuration of the information processing system including the display device 60 according to embodiment 2 of the present invention. Like reference characters are used to designate like or corresponding parts throughout FIG. 9 and FIG. 7.

As shown in FIG. 9, information processing system 70 includes plural image information processing devices 71 and plural display devices 60. Each of driver circuits 10 (hereinafter will be referred to as driver circuits D1, D2, . . . , Dn as in the above-described case) included in the source driver portion of each of the display devices 60 is assigned its own identification information. Each of the driver circuits D1, D2, . . . , Dn stores ID code data item indicative of its own identification information in a predetermined storage portion.

Each of the image information processing devices 71 modulates image information sequentially and/or in parallel by carrier frequencies f1, f2, . . . , fn and wirelessly transmits modulated image information items together with specific ID code data items. In this case each of the driver circuits D1, D2, . . . , Dn receives an image information item attached with an ID code data item identical with the ID code data item previously assigned thereto. Pixels of display panel 2 are driven by video signals outputted from the driver circuits D1, D2, . . . , Dn and scanning signals outputted from driver circuits 11, thereby to display the whole of desired high-definition and high-resolution image information on the display panel 2.

In each display device 60 each of the driver circuits D1, D2, . . . , Dn reads out video signal data stored in a storage portion (not shown) provided therein as transmitted data. Then, the driver circuits D1, D2, . . . , Dn each modulate the transmitted data into a respective one of the carrier frequencies f1, f2, . . . , fn and each wirelessly output part of the image information together with a respective one of the ID code data items of their own. Thus, each display device 60 can transmit and receive the whole or part of high-definition image information to and from each image information processing device 71 or other display device 60 properly without any error.

In the case of the above-described information processing system 70, since the driver circuits 10 of each display device 60 have their own ID code data items, each image information processing device and each display device become possible to transmit and receive video signals to and from each other without any error. Also, each image information processing device can transmit image information to only the specific driver circuit 10 identified by an ID code data item specified and update only an associated portion of screen. Thus, the time and electric power required for updating of an image can be reduced. This effect is advantageous particularly to a non-volatile display system such as an electrophoretic display system.

Of course, it is possible for the above-described method to establish such settings that communication of image information is inhibited between image processing devices and display devices having either a group of IDs other than specified ID code data items or driver circuits identified by ID code data items other than the specified ID code data items, hence, exchange of information is impossible therebeween.

Though description has been made of the display device employing display device driver circuits capable wireless input and output and the information processing system including the display device employing such driver circuits, use of driver circuits capable of only wireless input makes it possible to embody the present invention as a display device and an information processing system which transmit image information only one way.

While the display device according to any one of the foregoing embodiments is configured to receive analog signals modulated and carried by radio frequencies, perform A/D conversion and then demodulation, and carry out digital processing on the demodulated signals, the present invention may be embodied as a digital-signal display device which is configured to receive digital signals modulated and carried by radio frequencies, demodulate the signals without A/D conversion, and carry out digital processing on the demodulated signals.

While an active-matrix type display device has been described as the display device of the present invention in any one of the foregoing embodiments, it is needless to say that the display device of the present invention may be a passive-matrix type (simple-matrix type) display device.

Also, while an electrophoretic display panel (EPID) has been described as a flexible display panel in any one of the foregoing embodiments, it is possible to employ any one of memory display type display panels including a liquid-phase EPID, liquid crystal display panel (LCD), electrochromic display panel (ECD), electrodeposition display panel and a like display panel, or any one of non-memory display type display panels including a liquid crystal display panel (LCD), organic electroluminescent display panel (organic EL) and a like display panel.

The display device of the present invention is not limited to a flexible display but may be a display of glass such as a conventional LCD.

It will be apparent from the foregoing description that many improvements and other embodiments of the present invention may occur to those skilled in the art. Therefore, the foregoing description should be construed as an illustration only and is provided for the purpose of teaching the best mode for carrying out the present invention to those skilled in the art. The details of the structure and/or the function of the present invention can be modified substantially without departing from the spirit of the present invention.

INDUSTRIAL APPLICABILITY

The driver circuit and the display device according to the present invention are useful as a driver circuit for display devices required to provide high-definition and high-resolution display and as such a display device.

The invention claimed is:

1. A display device including: a matrix type display panel provided with plural pixels configured to display image information by a plurality of signal lines and a plurality of scanning lines which are provided on a substrate such that the plurality of signal lines and the plurality of scanning lines cross each other; and plural driver circuits configured to drive the plural pixels according to a video signal indicative of the image information which is inputted externally, the video signal being a radio signal;

the display device comprising:

plural wireless input portions each configured to obtain a part of the video signal from the radio signal, wherein the plural driver circuits are each configured to drive apart of the plural pixels according to the part of the video signal obtained by the wireless input portions.

2. The display device according to claim 1, wherein each of the plural driver circuits has a respective one of the wireless input portions and is configured to drive the part of the plural pixels according to the part of the video signal obtained by the respective one of the wireless input portions.

3. The display device according to claim 1, wherein:

the radio signal is an RF signal; and the wireless input portions are configured to demodulate the RF signal.

4. The display device according to claim 3, wherein the wireless input portions of respective of the plural driver circuits are each configured to receive a respective one of different frequencies.

5. The display device according to claim 1, wherein each of the driver circuits further comprises:

a storage portion configured to store the part of the video signal therein;

a signal transmitting portion configured to modulate the part of the video signal to generate a transmission signal; and a wireless output portion configured to wirelessly output the transmission signal generated by the signal transmitting portion.

6. The display device according to claim 2, wherein the driver circuits are each assigned identification information, and the wireless input portion configured to obtain the part of the video signal from the radio signal based on the identification information.

7. The display device according to claim 1, wherein the driver circuits are each a large scale integrated circuit.

8. The display device according to claim 1, wherein the driver circuits each comprise a thin film device circuit including a thin film transistor.

9. An information processing system comprising:

a display device including:

a matrix type display provided with plural pixels configured to display image information by a plurality of signal lines and a plurality of scanning lines which are provided on a substrate such that the plurality of signal lines and the plurality of scanning lines cross each other; and plural driver circuits configured to drive the plural pixels according to a video signal indicative of the image information which is inputted externally; and an image information processing device configured to transmit the video signal as a radio signal, wherein:

the display device includes plural wireless input portions each configured to obtain a part of the video signal from the radio signal; and the plural driver circuits are each configured to drive a part of the plural pixels according to the part of the video signal obtained by the wireless input portions.

10. The information processing system according to claim 9, wherein each of the plural driver circuits has a respective one of the wireless input portions and is configured to drive the part of the plural pixels according to the part of the video signal obtained by the respective one of the wireless input portions.

11. The information processing system according to claim 10, wherein:

the image information processing device is configured to divide the radio signal into plural radio signals and transmit the plural radio signals at a respective one of different carrier frequencies; and the wireless input portions of respective of the plural driver circuits are each configured to receive a respective one of different frequencies.

12. The information processing system according to claim 10, wherein:

the image information processing device is configured to transmit a radio signal containing identification information for identifying each of the driver circuits; and the wireless input portion is configured to obtain the part of the video signal from the radio signal based on the identification information.

13. A display device driver circuit for driving a pixel configured to display image information according to a video signal indicative of the image information which is inputted externally, the video signal being a radio signal, the driver circuit comprising a wireless input portion configured to obtain a part of the video signal from the radio signal, the driver circuit being operative to drive the pixel according to the part of the video signal obtained by the wireless input portion.

14. The driver circuit according to claim 13, wherein:

the radio signal is an RF signal; and the wireless input portion is operative to demodulate the RF signal.

15. The driver circuit according to claim 13, further comprising a power source portion configured to convert the received radio signal to electric power energy.

16. The driver circuit according to claim 13, further comprising:

a storage portion configured to store the part of the video signal;

a signal transmitting portion configured to modulate the part of the video signal to generate a transmission signal; and a wireless output portion configured to wirelessly output the transmission signal generated by the signal transmitting portion.

17. The driver circuit according to claim 13, which is assigned identification information, wherein the wireless input portion is configured to obtain the part of the video signal from the radio signal based on the identification information.

18. The driver circuit according to claim 13, which comprises a thin film device circuit including a thin film transistor.

19. The display device according to claim 1, wherein the substrate is a flexible substrate.

* * * * *

UNITED STATES PATENT AND TRADEMARK OFFICE

CERTIFICATE OF CORRECTION

PATENT NO. : 7,463,226 B2
APPLICATION NO. : 10/553228
DATED : December 9, 2008
INVENTOR(S) : Naohide Wakita It is certified that error appears in the above-identified patent and that said Letters Patent is hereby corrected as shown below:

IN THE CLAIMS:

In Column 15, Line 35 (Claim 1), change "drive apart of" to --drive a part of--.

Signed and Sealed this

Eleventh Day of August, 2009

David J. Kappos

David J. Kappos
*Director of the United States Patent and Trademark Office*